US005456458A

United States Patent [19]

Haupenthal

[11] Patent Number: 5,456,458

[45] Date of Patent: Oct. 10, 1995

[54] DEVICE FOR ADJUSTING THE POSITIONS OF SUCTION GRIPPERS ON A SHEET TRANSFER DRUM

[75] Inventor: Rudi Haupenthal, Epfenbach, Germany

[73] Assignee: Heidelberger Druckmaschinen AG, Heidelberg, Germany

[21] Appl. No.: 240,927

[22] Filed: May 10, 1994

[30] Foreign Application Priority Data

May 10, 1993 [DE] Germany ..... 43 15 497.2

[51] Int. Cl.[6] ..... B65H 5/02

[52] U.S. Cl. ..... 271/276; 271/196; 403/104; 403/110

[58] Field of Search ..... 271/90, 91, 94, 271/276, 196; 198/471.1, 803.5; 403/104, 109, 110

[56] References Cited

U.S. PATENT DOCUMENTS

| | | | |
|---|---|---|---|
| 1,505,220 | 8/1924 | Shay | 403/104 X |
| 2,090,550 | 7/1934 | Pilblad | 403/104 X |
| 2,251,253 | 7/1941 | Miller | 403/110 X |

FOREIGN PATENT DOCUMENTS

| | | | |
|---|---|---|---|
| 770997 | 9/1934 | France | 271/90 |
| 626258 | 9/1978 | U.S.S.R. | 403/104 |

OTHER PUBLICATIONS

Japanese Patent No. 4–153039 (Takeda), May 26, 1992.

Japanese Patent No. 4–161336 (Sumitomo Jukikai Kogyo K,K), Jun. 4, 1992.

Japanese Patent No. 4–158041 (Sumitomo), Jun. 1, 1992.

*Primary Examiner*—H. Grant Skaggs

*Attorney, Agent, or Firm*—Herbert L. Lerner; Laurence A. Greenberg

[57] ABSTRACT

Device for adjusting the position of suction grippers on a sheet transfer drum for conveying sheets in a sheet-fed rotary printing press, at least some of the grippers being formed as suction grippers, at least one guide bar carried by the sheet transfer drum, holding elements mounted on the guide bar and having the respective suction grippers seated thereon, the suction grippers being manually displaceable along a generatrix of a cylindrical outer surface of the sheet transfer drum perpendicularly to a sheet conveying direction and being fixable thereon, includes a respective manually actuatable locking member connected to each of the holding elements for retaining the respective holding element in position on the guiding bar by frictional forces applied to the guiding bar at opposite sides of the respective holding element, the clamping element being an individual spring.

1 Claim, 1 Drawing Sheet

DEVICE FOR ADJUSTING THE POSITIONS OF SUCTION GRIPPERS ON A SHEET TRANSFER DRUM

Figure 1:
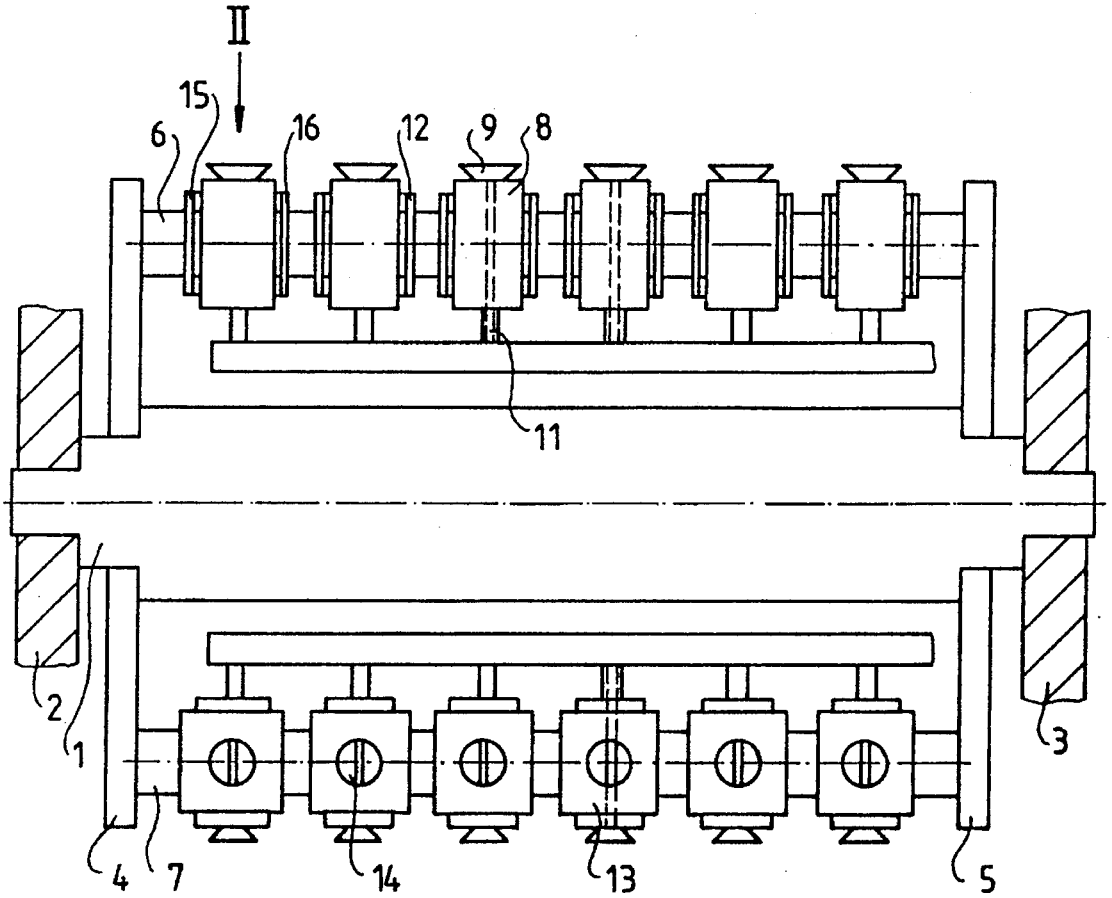

The invention relates to a device for adjusting or setting the positions of suction grippers on a sheet transfer drum and is accordingly usable in sheet-fed rotary printing presses wherein sheet-transfer drums are provided for conveying sheets, the sheets being held in grippers on the sheet-transfer drums, at least some of the grippers being constructed as suction grippers.

Whenever a job change occurs wherein sheets of a different format are to be printed, it is advantageous to adapt the position of the suction grippers on the outer cylindrical surface of the sheet transfer drum to suit the new format to be printed. For this purpose, devices permitting the adjustment of the positions of the suction grippers individually or group-wise in the rotational direction and perpendicularly to the rotational direction of the sheet are used. Simultaneously with the adjustment of the positions of the suction grippers, it is possible for the sheet-holding surface on the outer cylindrical surface to be adapted to suit or matched to the new sheet format to be printed.

Heretofore known devices achieve such an adaptation to a new sheet format in that the suction grippers, in accordance with the sheet length, are adjusted through a defined angular value about the axis of rotation of the sheet transfer drum, and in that the suction grippers which are disposed in a direction perpendicular to the sheet-travel direction outside or beyond the new sheet format width are set out of operation. Thus, the position of the suction grippers in a direction perpendicular to the sheet-travel direction is maintained, the suction air being removed only from the non-used suction grippers (note: Japanese Patents 4-161336, 4-153039 and 4-158041, for example).

A disadvantage thereof is that not all of the suction grippers extending transversely to the sheet-travel direction are used to retain small-format sheets, and that a special device which is material-intensive and cost-intensive and does not permit the application of a maximum holding force must be provided to shut off the suction air from the suction grippers which are not needed.

With relatively simple means, it is possible to adjust the suction grippers manually to a new sheet format transversely to the sheet-travel direction. For this purpose, the suction grippers may be fixed in a rectilinear guide by means of a clamping screw. To adjust the suction grippers, the clamping screws of the suction grippers are loosened, i.e., unscrewed, individually, and the suction-type grippers are preferably shifted or slid along a scale to assume a new position within the guide. In the new position, the suction grippers are clamped anew. The suction grippers may be connected to a suction-air source via flexible tubes or hoses and a rotary lead-in or pass-through.

A disadvantage of such constructions of the prior art is that the re-adjustment of the suction grippers to a new format or size is time-consuming, the sheet transfer drums being generally surrounded by further components of the printing press so that the clamping screws are not easily accessible for manual adjustment and the positioning accuracy is consequently impaired.

It is accordingly an object of the invention to provide a device for manually adjusting the position of suction grippers on a sheet relatively easily, the device permitting a quick adjustment of the suction grippers transversely to the sheet-travel direction, all of the suction grippers arranged over the width of a sheet-transfer drum being utilizable for securely or firmly holding sheets of any format or size.

With the foregoing and other objects in view, there is provided, in accordance with the invention, a device for adjusting the position of suction grippers on a sheet transfer drum for conveying sheets in a sheet-fed rotary printing press, at least some of the grippers being formed as suction grippers, at least one guide bar carried by the sheet transfer drum, holding elements mounted on the guide bar and having the respective suction grippers seated thereon, the suction grippers being manually displaceable along a generatrix of a cylindrical outer surface of the sheet transfer drum perpendicularly to a sheet conveying direction and being fixable thereon, comprising a respective manually actuatable locking member connected to each of the holding elements for retaining the respective holding element in position on the guiding bar by frictional forces applied to the guiding bar at opposite sides of the respective holding element, the locking member being an individual spring.

In accordance with a concomitant feature of the invention, the individual spring is of U-shaped construction, having a cross-piece between two legs, the cross-piece being firmly connected to a surface of the respective holding element extending parallel to an axis of the guide bar, the legs of the individual spring, respectively, and the respective holding element being formed with coaxial openings through which the guide bar extends, the legs of the individual spring being movable simultaneously towards surfaces at the opposite sides of the respective holding element for releasing the respective holding element.

Thus, for releasing or loosening the locking member, the spring legs may be manually pressed against or towards the opposite parallel surfaces of the holding element. In this condition, the holding element is displaceable on the guide bar together with the suction-type grippers. After the spring legs have been released, the spring force urges the legs against the guide bar, thus producing frictional forces which prevent an undesired adjustment of the position of the suction-type grippers.

Other features which are considered as characteristic for the invention are set forth in the appended claims.

Although the invention is illustrated and described herein as embodied in a device for adjusting the position of suction grippers on a sheet transfer drum, it is nevertheless not intended to be limited to the details shown, since various modifications and structural changes may be made therein without departing from the spirit of the invention and within the scope and range of equivalents of the claims.

Figure 2:
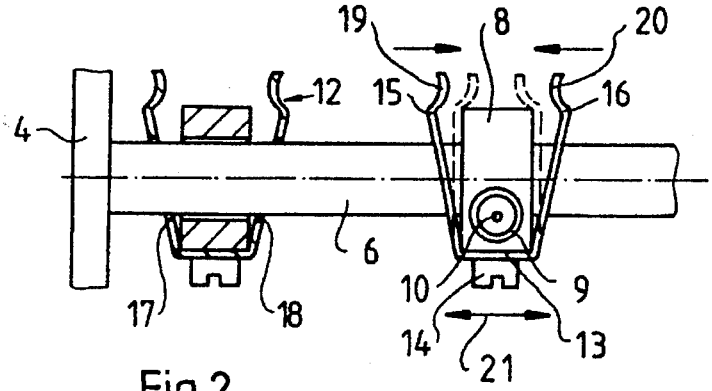

The construction and method of operation of the invention, however, together with additional objects and advantages thereof will be best understood from the following description of specific embodiments when read in connection with the accompanying drawings, in which:

FIG. 1 is a diagrammatic longitudinal sectional view of a sheet transfer drum; and FIG. 2 is a fragmentary top plan view, partly in section, of FIG. 1, showing a suction gripper being adjusted from one to another position.

Referring now to the drawing and, first, particularly to FIG. 1 thereof, there is shown therein a sheet transfer drum 1 supported in side walls 2 and 3 of a printing press. A respective disk plate 4, 5 is flanged on each side or end of the sheet transfer drum 1. The disk plates 4 and 5 are connected to one another by guide bars 6 and 7. Each of the guide bars 6 and 7, respectively, has six holding elements 8 with suckers 9 seated thereon. Due to the form of the guide bars 6 and 7, e.g., they may have an elliptical or rectangular cross section extending through correspondingly formed openings provided in the respective holding elements 8, the latter are fixed against rotation relative to the respective guide bars 6 and 7. Each of the suckers 9 is formed with a suction bore 10 which is connectible to a suction-air source via the respective holding element 8 and a hose or tube 11. Each of the holding elements 8 is held on the respective guide bar 6, 7 by means of a spring 12. The springs 12 have a U-shaped construction. A cross-piece 13 of each spring 12, respectively, is fixed on the respective holding element 8 by means of a screw 14. Legs 15 and 16 of each spring 12 are formed with respective openings 17 and 18 through which the respective guide bar 6, 7 extends.

For adjusting the position of the suckers 9 to a new sheet format or size, the respective leg ends 19 and 20 of the springs 12 are manually brought into the position thereof represented by broken lines and pressed against parallel lateral surfaces of the respective holding element 8, as shown in FIG. 2. The holding element 8 is thereby released or loosened on the respective guide bar 6, 7, and can be displaced towards the ends 19 and 20 of the legs 15 and 16, respectively, of the spring 12, in the direction of the double arrow 21. In the new position of the holding elements 8 and the suckers 9, respectively, the gripping leg ends 19 and 20 are released so that the spring 12 acting as a lock presses against the guide bars 6 and 7, respectively, and thereby prevents any undesired adjustment of the position of the suction grippers.

I claim:

1. Device for adjusting the position of suction grippers on a sheet transfer drum for conveying sheets in a sheet-fed rotary printing press, at least some of the grippers being formed as suction grippers, at least one guide bar carried by the sheet transfer drum, holding elements mounted on the guide bar and having the respective suction grippers seated thereon, the suction grippers being manually displaceable along a generatrix of a cylindrical outer surface of the sheet transfer drum perpendicularly to a sheet conveying direction and being fixable thereon, comprising a respective manually actuatable locking member connected to each of the holding elements for retaining the respective holding element in position on the guide bar by frictional forces applied to the guide bar at opposite sides of the respective holding element, said locking member being an individual spring, said individual spring being of U-shaped construction, having a cross-piece between two legs, said cross-piece being firmly connected to a surface of the respective holding element extending parallel to an axis of the guide bar, said legs of said individual spring, respectively, and the respective holding element being formed with coaxial openings through which the guide bar extends, said legs of said individual spring being movable simultaneously towards surfaces at said opposite sides of the respective holding element for releasing the respective holding element.

* * * * *